US012685336B2

(12) United States Patent
Reevell

(10) Patent No.: US 12,685,336 B2
(45) Date of Patent: Jul. 21, 2026

(54) METHOD OF MAKING DEVICE WITH CHAMBERS CONFIGURED TO ACCEPT CONSUMABLE

(71) Applicant: Altria Client Services LLC, Richmond, VA (US)

(72) Inventor: Tony Reevell, London (GB)

(73) Assignee: Altria Client Services LLC, Richmond, VA (US)

( * ) Notice: Subject to any disclaimer, the term of this patent is extended or adjusted under 35 U.S.C. 154(b) by 107 days.

(21) Appl. No.: 18/484,517

(22) Filed: Oct. 11, 2023

(65) Prior Publication Data

US 2024/0032591 A1 Feb. 1, 2024

Related U.S. Application Data

(60) Division of application No. 17/718,611, filed on Apr. 12, 2022, now Pat. No. 11,819,056, which is a (Continued)

(30) Foreign Application Priority Data

Jan. 31, 2017 (EP) ..... 17153928

(51) Int. Cl.
*A24F 40/30* (2020.01)
*A24F 40/10* (2020.01)
(Continued)

(52) U.S. Cl.
CPC ..... *A24F 40/30* (2020.01); *A24F 40/485* (2020.01); *A24F 40/60* (2020.01); *A24F 40/10* (2020.01); *A24F 40/20* (2020.01)

(58) Field of Classification Search
CPC ..... A24F 40/30; A24F 40/485; A24F 40/42
See application file for complete search history.

(56) References Cited

U.S. PATENT DOCUMENTS

2012/0048266 A1 3/2012 Alelov
2013/0014772 A1 1/2013 Liu
(Continued)

FOREIGN PATENT DOCUMENTS

CN 204907924 U 12/2015
CN 105473012 A 4/2016
(Continued)

OTHER PUBLICATIONS

Korean Notice of Allowance, dated Dec. 12, 2023, issued in Korean Patent Application No. 10-2019-7019560.
(Continued)

*Primary Examiner* — Michael H. Wilson
*Assistant Examiner* — Jennifer A Kessie
(74) *Attorney, Agent, or Firm* — Harness, Dickey & Pierce, P.L.C.

(57) ABSTRACT

The method includes establishing a housing defining chambers, the chambers including a first chamber and a second chamber, each of the chambers being configured to accept a consumable, and configuring a mouthpiece to be selectively connected to the housing on an end of the chambers in at least a first position or a second position, the first position aligning an inlet opening of the mouthpiece to direct at least one first airflow in a first direction through the first chamber and in a second direction through the second chamber, the second position aligning the inlet opening of the mouthpiece to direct the at least one first airflow in the first direction through the second chamber and in the second direction through the first chamber, the first direction and the second direction being substantially opposite directions.

20 Claims, 4 Drawing Sheets

Related U.S. Application Data division of application No. 15/885,143, filed on Jan. 31, 2018, now Pat. No. 11,311,047, which is a continuation of application No. PCT/EP2017/084164, filed on Dec. 21, 2017.

(51) Int. Cl.

| | |
|---|---|
| ***A24F 40/20*** | (2020.01) |
| ***A24F 40/485*** | (2020.01) |
| ***A24F 40/60*** | (2020.01) |

(56) References Cited

U.S. PATENT DOCUMENTS

| | | | | |
|---|---|---|---|---|
| 2013/0333700 | A1 | 12/2013 | Buchberger | |
| 2014/0060556 | A1 | 3/2014 | Liu | |
| 2015/0128971 | A1 | 5/2015 | Verleur et al. | |
| 2017/0304563 | A1* | 10/2017 | Adelson | A61M 15/003 |
| 2018/0228216 | A1 | 8/2018 | Saygili | |

FOREIGN PATENT DOCUMENTS

| | | | |
|---|---|---|---|
| CN | 105722416 | A | 6/2016 |
| CN | 105792691 | A | 7/2016 |
| EP | 2989912 | A1 | 3/2016 |
| GB | 2522727 | B | 1/2017 |
| JP | S62-103088 | A | 1/1989 |
| JP | S649598 | U | 1/1989 |
| JP | 2016-535982 | A | 11/2016 |
| JP | 6409598 | B2 | 10/2018 |
| KR | 200465795 | Y1 | 3/2013 |
| RU | 114405 | U1 | 3/2012 |
| WO | WO-2015/079197 | A1 | 6/2015 |
| WO | WO-2015/179388 | A1 | 11/2015 |
| WO | WO-2016/135331 | A1 | 9/2016 |
| WO | WO-2016/135342 | A2 | 9/2016 |
| WO | WO-2016/179376 | A1 | 11/2016 |

OTHER PUBLICATIONS

"British American to test tobacco/e-cigarette hybrid" http://www.reuters.com/article/us-brit-am-tobacco-products-idUSKCN0T71U020151118.

"HVS—Hybrid Vaping System", http://jinjiatech.com/PRODUCTS/Heat/91.

European Search Report for European Patent Application No. 17153928.1 Dated Jul. 10, 2017.

International Search Report and Written Opinion for PCT/EP2017/084164 mailed Apr. 16, 2018.

International Preliminary Report on Patentability issued Aug. 15, 2019 for corresponding PCT Application No. PCT/EP2017/084164.

Russian Office Action and Search Report dated Apr. 22, 2021, issued in corresponding Russian Patent Application No. 2019120516.

Office Action dated Oct. 26, 2021, issued in corresponding Chinese Patent Application No. 201780082384.8.

Decision to Grant dated Nov. 19, 2021, issued in corresponding Russian Patent Application No. 2019120516.

Office Action dated Dec. 22, 2021, issued in corresponding Japanese Patent Application No. 2019-539991.

European Examination issued Apr. 20, 2022 in European Application No. 17828910.4.

Office Action dated Jul. 22, 2022, issued in corresponding Japanese Patent Application No. 2019-539991.

Office Action dated Dec. 2, 2022 issued in related Korean patent application No. 10-2019-7019560.

Office Action dated Feb. 9, 2023, issued in corresponding Japanese Patent Application No. 2019-539991.

European Office Action dated Jan. 22, 2026 issued in European Patent Application No. 17828910.4.

* cited by examiner

METHOD OF MAKING DEVICE WITH CHAMBERS CONFIGURED TO ACCEPT CONSUMABLE

CROSS-REFERENCE TO RELATED APPLICATION

This application is a divisional of U.S. application Ser. No. 17/718,611, filed Apr. 12, 2022, which is a divisional of U.S. application Ser. No. 15/885,143, filed Jan. 31, 2018, which is a continuation of and claims priority to international application number PCT/EP2017/084164, filed on Dec. 21, 2017, and further claims priority under 35 USC § 119 to European patent application number 17153928.1, filed Jan. 31, 2017, the entire contents of each of which are incorporated herein by reference.

BACKGROUND

Field

Example embodiments relate to aerosol-generating devices. In particular, example embodiments relate to aerosol-generating devices suitable for being used with more than one consumable, where the consumables may be different types of consumables.

Description of Related Art

Aerosol-generating devices are known to use a liquid to be evaporated or a tobacco material to be heated. The evaporation of the liquid is combined with heating tobacco.

SUMMARY

At least one example embodiment is directed toward an aerosol-generating device.

In one embodiment, the aerosol-generating device includes a device housing; a mouthpiece on an end of the device housing; a first receiving chamber defined within the device housing, the first receiving chamber configured to receive and accommodate a first consumable; a second receiving chamber defined within the device housing, the second receiving chamber configured to receive and accommodate a second consumable; a selection member arrangeable in a first position and a second position, wherein in the first position the selection member establishes a first airflow passageway that traverses through the first receiving chamber while circumventing the second receiving chamber, and in the second position the selection member establishes a second airflow passageway that traverses through the second receiving chamber while circumventing the first receiving chamber.

In one embodiment, the mouthpiece mounts on the device housing and is configured to cover one of a first receiving opening of the first receiving chamber and a second receiving opening of the second receiving chamber.

In one embodiment, the selection member is arranged to be in one of the mouthpiece and the device housing.

In one embodiment, the selection member is one of a switch and a valve configured to be movable between the first position and the second position.

In one embodiment, the selection member is integrated into the mouthpiece, and the mouthpiece defines an inlet opening that is alignable with either one of the first receiving chamber and the second receiving chamber to establish one of the first airflow passageway and the second airflow passageway.

In one embodiment, the mouthpiece includes a bottom wall configured to close one of the first receiving opening and the second receiving opening.

In one embodiment, the first receiving chamber and the second receiving chamber each include at least one of a heating element for heating the respective first or second consumable, and electrical contacts connectable to an external heating element for heating the respective first or second consumable.

In one embodiment, the heating element is one of arranged in a receiving chamber wall of the respective first or second receiving chamber, and extends into the respective first or second receiving chamber.

In one embodiment, the receiving chamber wall includes an aligning element for aligning the respective first or second consumable within the respective first or second receiving chamber.

In one embodiment, the aerosol-generating device further includes at least one third receiving chamber defined within the device housing, the at least one third receiving chamber being configured to receive and accommodate at least a third consumable, wherein the selection member is arrangeable in at least one third position, the at least one third position establishing a third airflow passageway that traverses through the at least one third receiving chamber while circumventing the first and second receiving chambers.

In one embodiment, the first consumable is arranged in the first receiving chamber, and the second consumable is arranged in the second receiving chamber.

In one embodiment, the first consumable includes an aerosol-forming liquid and the second consumable includes a solid tobacco material, the first receiving chamber including the heating element for heating the aerosol-forming liquid.

In one embodiment, two or more of the first consumable, the second consumable and the at least one third consumable is arranged side-by side in the device housing, and the mouthpiece defines an inlet opening that is alignable with only one of the first consumable, the second consumable and the at least one third consumable.

At least another example embodiment relates to a method for selecting use of a consumable of an aerosol-generating device In one embodiment, the method includes providing at least two consumables in a housing of the aerosol-generating device; establishing an airflow through a selected one of the at least two consumables, while circumventing the airflow from passing through a non-selected one of the at least two consumables; and guiding the airflow from the selected one of the at least two consumables to an outlet opening of a mouthpiece.

In one embodiment, the establishing of the airflow includes, aligning an inlet opening of the mouthpiece with the selected one of the at least two consumables, and blocking the airflow from passing through the non-selected one of the at least two consumables using a bottom wall portion of the mouthpiece.

BRIEF DESCRIPTION OF THE DRAWINGS

Features described in relation to one example embodiment may equally be applied to other example embodiments.

Example embodiments will now be described with reference to the following drawings.

DETAILED DESCRIPTION

Figure 1:
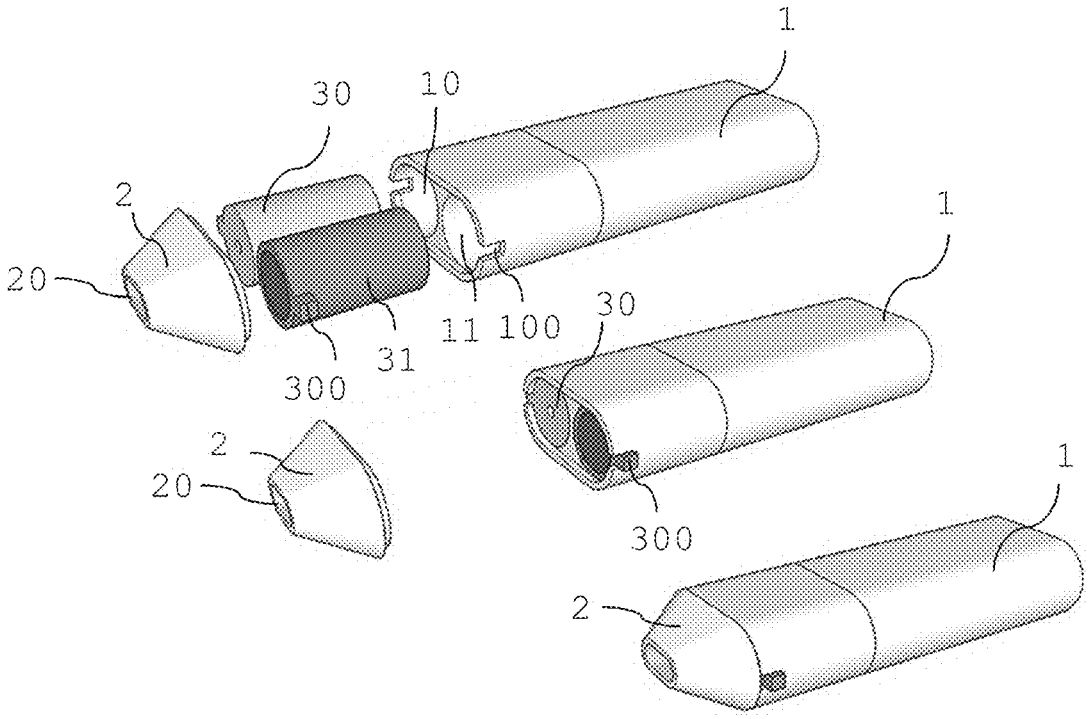
FIG. 1 illustrates assembled and disassembled views of an aerosol-generating device including a first and a second consumable, in accordance with an example embodiment.

Example embodiments will become more readily understood by reference to the following detailed description of the accompanying drawings. Example embodiments may, however, be embodied in many different forms and should not be construed as being limited to the example embodiments set forth herein. Rather, these example embodiments are provided so that this disclosure will be thorough and complete. Like reference numerals refer to like elements throughout the specification.

The terminology used herein is for the purpose of describing particular embodiments only and is not intended to be limiting. As used herein, the singular forms "a", "an" and "the" are intended to include the plural forms as well, unless the context clearly indicates otherwise. It will be further understood that the terms "comprises," "comprising," "includes," and/or "including," when used in this specification, specify the presence of stated features, integers, steps, operations, elements, and/or components, but do not preclude the presence or addition of one or more other features, integers, steps, operations, elements, components, and/or groups thereof.

It will be understood that when an element or layer is referred to as being "on", "connected to" or "coupled to" another element or layer, it can be directly on, connected or coupled to the other element or layer or intervening elements or layers may be present. In contrast, when an element is referred to as being "directly on", "directly connected to" or "directly coupled to" another element or layer, there are no intervening elements or layers present. As used herein, the term "and/or" includes any and all combinations of one or more of the associated listed items.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings set forth herein.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Example embodiments are described herein with reference to cross-section illustrations that are schematic illustrations of idealized embodiments (and intermediate structures). As such, variations from the shapes of the illustrations as a result, for example, of manufacturing techniques and/or tolerances, are to be expected. Thus, these example embodiments should not be construed as limited to the particular shapes of regions illustrated herein, but are to include deviations in shapes that result, for example, from manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the figures are schematic in nature and their shapes are not intended to illustrate the actual shape of a region of a device and are not intended to limit the scope of this disclosure.

Unless otherwise defined, all terms (including technical and scientific terms) used herein have the same meaning as commonly understood by one of ordinary skill in the art. It will be further understood that terms, such as those defined in commonly used dictionaries, should be interpreted as having a meaning that is consistent with their meaning in the context of the relevant art and this specification and will not be interpreted in an idealized or overly formal sense unless expressly so defined herein.

Unless specifically stated otherwise, or as is apparent from the discussion, terms such as "processing" or "computing" or "calculating" or "determining" or "displaying" or the like, refer to the action and processes of a computer system, or similar electronic computing device, that manipulates and transforms data represented as physical, electronic quantities within the computer system's registers and memories into other data similarly represented as physical quantities within the computer system memories or registers or other such information storage, transmission or display devices.

In the following description, illustrative embodiments may be described with reference to acts and symbolic representations of operations (e.g., in the form of flow charts, flow diagrams, data flow diagrams, structure diagrams, block diagrams, etc.) that may be implemented as program modules or functional processes including routines, programs, objects, components, data structures, etc., that perform particular tasks or implement particular abstract data types. The operations be implemented using existing hardware in existing electronic systems, such as one or more microprocessors, Central Processing Units (CPUs), digital signal processors (DSPs), application-specific-integrated-circuits (ASICs), SoCs, field programmable gate arrays (FPGAs), computers, or the like.

Further, one or more example embodiments may be (or include) hardware, firmware, hardware executing software, or any combination thereof. Such hardware may include one or more microprocessors, CPUs, SoCs, DSPs, ASICs, FPGAs, computers, or the like, configured as special purpose machines to perform the functions described herein as well as any other well-known functions of these elements. In at least some cases, CPUs, SoCs, DSPs, ASICs and FPGAs may generally be referred to as processing circuits, processors and/or microprocessors.

Although processes may be described with regard to sequential operations, many of the operations may be performed in parallel, concurrently or simultaneously. In addition, the order of the operations may be re-arranged. A process may be terminated when its operations are completed, but may also have additional steps not included in the figure. A process may correspond to a method, function, procedure, subroutine, subprogram, etc. When a process corresponds to a function, its termination may correspond to a return of the function to the calling function or the main function.

As disclosed herein, the term "storage medium", "computer readable storage medium" or "non-transitory computer readable storage medium," may represent one or more devices for storing data, including read only memory (ROM), random access memory (RAM), magnetic RAM, core memory, magnetic disk storage mediums, optical storage mediums, flash memory devices and/or other tangible machine readable mediums for storing information. The term "computer-readable medium" may include, but is not limited to, portable or fixed storage devices, optical storage devices, and various other mediums capable of storing, containing or carrying instruction(s) and/or data.

Furthermore, at least some portions of example embodiments may be implemented by hardware, software, firmware, middleware, microcode, hardware description languages, or any combination thereof. When implemented in software, firmware, middleware or microcode, the program code or code segments to perform the necessary tasks may be stored in a machine or computer readable medium such as a computer readable storage medium. When implemented in software, processor(s), processing circuit(s), or processing unit(s) may be programmed to perform the necessary tasks, thereby being transformed into special purpose processor(s) or computer(s).

A code segment may represent a procedure, function, subprogram, program, routine, subroutine, module, software package, class, or any combination of instructions, data structures or program statements. A code segment may be coupled to another code segment or a hardware circuit by passing and/or receiving information, data, arguments, parameters or memory contents. Information, arguments, parameters, data, etc. may be passed, forwarded, or transmitted via any suitable means including memory sharing, message passing, token passing, network transmission, etc.

General Methodology

In an example embodiment, aerosol-generating devices can include two cartridges including different liquids that are provided for selective parallel evaporation of the different liquids. In an embodiment, an aerosol-generating device provides a choice for using different consumables.

Example embodiments provide an aerosol-generating (also referred to as "vapor-generating") device including a device housing and a mouthpiece. The device housing includes a first receiving chamber for receiving and accommodating a first consumable and a second receiving chamber for receiving and accommodating a second consumable. The device further includes a selection member arrangeable in a first position and in a second position. In the first position the selection member leaves open an airflow passageway through the first receiving chamber and closes the airflow passageway through the second receiving chamber. In the second position the selection member closes the airflow passageway through the first receiving chamber and leaves open the airflow passageway through the second receiving chamber.

By selection of the position of the selection member, the device provides a choice of receiving chambers that are 'active', allowing the consumable in the receiving chamber to be used. For example, a selection may be made between a flavor-base experience or a nicotine-based experience, or possibly both.

The choice of the consumable to be used is directly correlated to an airflow through the respective receiving chamber and the consumable accommodated therein. An airflow through other non-selected receiving chambers in the device, and the corresponding consumables accommodated in those non-selected receiving chambers, is blocked. Thus, no substances vaporized from or otherwise leaving said other 'blocked' (non-selected) consumables are transported to a mouthpiece, respectively.

Substances from a consumable may be transported by an airflow passing through or by the consumable. These substances may simply be entrained by the passing airflow. For example, an airflow passing a tobacco substrate may be entrained with tobacco flavor. In an embodiment, the substances to be vaporized are actively generated, for example, by heating or otherwise vaporizing or atomizing a substance of the consumable.

If aerosolization is available, a blocked airflow passageway is combined with an inactive aerosolization device. For example, for a blocked passageway, the device does not provide an electrical current to the respective atomization device for that blocked passageway. That is to say, a heating element or vibrating element in the device or in the consumable, that is associated with the blocked passageway, does not receive an electrical current from the device. In an embodiment, the device does not supply an electrical current to a heater in the device, or to the consumable, when the consumable is not selected.

Various types of consumables may be used or may be determined to be usable with the aerosol-generating device, according to example embodiments.

Examples of consumables are, for example, but not limited to: liquid containing cartridges, or tank systems including or excluding an integrated aerosolization element, such as for example a cartridge, or a combined cartridge and atomizer; solid substrate containing consumables such as for example tobacco containing plugs; solid substrate containing capsules, wherein the solid substrate may be tobacco material, homogenized tobacco material or a substrate in powdered form; vaporisable wax; or tobacco sheets that are gathered or crimped.

In an embodiment, a first receiving chamber for a consumable is accommodated that includes a liquid aerosol-forming substrate. In an embodiment, in the second receiving chamber a consumable is accommodated that includes a solid substrate, such as a solid tobacco substrate. A first and a second receiving chamber may also include two consumables of a same kind, for example two liquid containing cartridges. In an embodiment, the cartridges contain a different liquid, for example with different flavor or different substance combinations. The second consumable may make use of a different method for releasing substances from the consumable, as compared to the first consumable. For example, when a first consumable in the first receiving chamber includes a heatable liquid, the second consumable in the second receiving chamber may be a non-heated tobacco substrate.

In the device according to an example embodiment, the mouthpiece when mounted to the device housing covers a first receiving opening of the first receiving chamber and covers a second receiving opening of the second receiving chamber. Both receiving chambers and consumables, when accommodated in the receiving chambers, are covered by one mouthpiece. If only the first consumable is selected, or if only the second consumable is selected, the vaporized substance from either the first or the second consumable passes through the mouthpiece.

For selecting a receiving chamber or a consumable, respectively, the selection member may be arranged in the mouthpiece or in the device housing.

The selection member may, for example, be a switch or valve arranged to be movable into an airflow passageway in the device, and may be removable from the airflow passageway. Thereby, the airflow passageway through the first receiving chamber is closed and the airflow passageway through the second receiving chamber is left open, or the airflow passageway through the first receiving chamber is left open and the airflow passageway through the second receiving chamber is closed. Such a switch or valve may be arranged in the device housing or in the mouthpiece. In an embodiment, such a switch or valve is arranged in the device housing, for example configured to close or keep open a distal end of a respective receiving chamber.

In an embodiment, the selection member is integrated into the mouthpiece. The mouthpiece may include an inlet opening, which is alignable with either one of the first receiving chamber or with the second receiving chamber when the mouthpiece is mounted to the device housing. Thereby, an airflow passageway is formed through either the first receiving chamber or through the second receiving chamber, via an inlet opening of the mouthpiece into and through the mouthpiece and to an outlet opening of the mouthpiece. In an embodiment, the mouthpiece includes an asymmetric geometry with respect to an airflow passage into the mouthpiece. For example, an inlet opening in a bottom wall of the mouthpiece may be arranged not in the center of the bottom wall, but rather near a side of the bottom wall.

In an embodiment, the mouthpiece includes a symmetric outer shape when mounted on the device housing.

The device may include an indicator, indicating the position of the selection member. Thus, the indicator may identify the consumable in the device that is ready for being used, or that is in use.

An indicator may be a drawn indicator, a printed indicator or a tactile indicator. In an embodiment, the indicator is an arrow pointing to the consumable in use. In an embodiment, the indicator is provided on the mouthpiece.

For closing an airflow passageway, either through the first or through the second receiving chamber, the mouthpiece may include a bottom wall that closes either one of the first receiving opening of the first receiving chamber or the second receiving opening of the second receiving chamber. When an inlet opening of the mouthpiece is aligned with the first receiving chamber, the bottom wall closes the receiving opening of the second receiving chamber, and vice versa.

In an embodiment, for aerosolization of a consumable or of substances included in the consumable, the substrate is heated. This may be accomplished by heating the substrate via a heating element in the consumable, or by providing a heating element in the device. If a heating element or another atomization element is included in the consumable itself, the receiving chamber may comprise respective electrical contacts for connecting an electrical power source in the device to the consumable for providing a required electrical current to the atomization element in the consumable.

Heating of a consumable may be performed resistively or inductively. A resistively heatable heating element may be provided in the device or in the consumable. With inductive heating, an inductor, for example an induction coil, may be provided in the device. A susceptor material heated by the inductor may be provided in the device or in the consumable.

The first receiving chamber or the second receiving chamber may include a heating element for heating a consumable accommodated in the respective receiving chamber.

The first receiving chamber or the second receiving chamber may include electrical contacts connectable to an external atomization element of a consumable for atomizing substances in said consumable accommodated in the respective receiving chamber. In an embodiment, the consumable includes a heating element for heating the consumable or an aerosol-forming substrate of the consumable.

A first receiving chamber may include a heating element and a second receiving chamber may include electrical contacts.

A first as well as a second receiving chamber may include both a heating element and electrical contacts for an external atomization element. This provides many options for different consumables to be used with the aerosol-generating device, according to an example embodiment. This also facilitates use of the device by not having to check if a receiving chamber is adapted for a specific consumable or aerosolization option.

A heating element in the device may be arranged in a receiving chamber wall. For example resistively heatable metal tracks may be arranged at a receiving chamber wall or resistively heatable wires may be arranged in the receiving chamber wall. An inductor in the form of an induction coil may be arranged in a receiving chamber wall, and may surround a consumable accommodated in the receiving chamber.

A heating element in the device may extend into the first receiving chamber or into the second receiving chamber. For example, the heating element may be a resistively heated heater blade or an elongated susceptor.

The device housing may include a third, or further, receiving chambers for receiving and accommodating a third, or further, consumables. The selection member is arrangeable in a third, or further, position. In the third, or further position, the selection member leaves open an airflow passageway through the third, or further, receiving chambers, while keeping the airflow passageways thorough the other receiving chambers closed.

The third, or further, receiving chambers may include a same or a different consumable as compared to the first or second receiving chamber, or as compared to the other receiving chambers. The third, or further, receiving chambers may include a heating element or electrical contacts for an external atomization element of a consumable. The third, or further, receiving chambers may include both a heating element as well as electrical contacts.

In an embodiment, all receiving chambers are arranged side by side in a device housing.

Receiving chamber walls may include an aligning element for aligning a consumable in a respective receiving chamber. An aligning element may, for example, be one or several longitudinal slits in the receiving chamber wall for insertion of one or several protrusions of a consumable. For example, one or several protrusions may be arranged at and may be laterally extending from a circumference of a consumable. For example, a consumable may be provided with one or several lugs for insertion into respective slits in the receiving chamber wall. Such aligning members on a consumable may also serve for removal of a consumable from the device housing. In an embodiment, aligning members of consumables, and aligning elements of receiving chambers, may be joined via a form-fit.

In an embodiment, the device includes a controller for controlling an operation of the device. In particular, the controller is configured to control a heating of a consumable or atomization of a substance of a consumable. For example, the controller controls a power supply to a heating element in the receiving chamber or power supply to a consumable including an atomization element, for example a heating element. The controller may also control a charging status of a power source of the device, a presence or absence of a consumable in a receiving chamber, or an operation mode of specific consumables.

A selection member may directly be linked to a controller providing the respective information to the controller corresponding to a consumable which is selected by the selection member.

While only one consumable may be accommodated in the device, in an embodiment, the aerosol-generating device includes a first consumable arranged in the first receiving chamber and includes a second consumable arranged in the second receiving chamber. Further receiving chambers may be available and further consumables may be arranged in the further receiving chambers.

In an embodiment, the first consumable includes an aerosol-forming liquid and a heating element for heating the aerosol-forming liquid.

In an embodiment, the second consumable includes a solid tobacco material, which may be a heatable tobacco substrate or a non-heated tobacco substrate.

The device may include two or more consumables arranged side-by side in the device housing.

In an embodiment, a mouthpiece covers all consumables in the device but an inlet opening of the mouthpiece is aligned with only one of the two or more consumables.

According to an example embodiment, there is further provided a method for selecting use of a consumable of an aerosol-generating device. The method includes the steps of providing at least two consumables in an aerosol-generating device and guiding an airflow through one of the at least two consumables, while preventing the airflow to pass through the other consumables of the at least two consumables. The method further includes the step of further guiding the airflow having passed the one consumable to an outlet opening of a mouthpiece of the device.

The step of allowing an airflow to pass through one of the at least two consumables, while preventing the airflow to pass through the other consumables of the at least two consumables may include aligning an inlet opening in the mouthpiece with one of the at least two consumables thereby forming an airflow passageway through one of the at least two consumable and the mouthpiece, and blocking an airflow passageway between the other consumables and the mouthpiece by a bottom wall portion of the mouthpiece.

Further aspects of the method according to example embodiments have been described relating to the aerosol-generating device and will not be repeated.

According to another aspect of the example embodiments there is provided an aerosol-generating device including a device housing and a mouthpiece; the device housing includes a first receiving chamber for receiving and accommodating a first consumable and a second receiving chamber for receiving and accommodating a second consumable; the mouthpiece when mounted to the device housing covering a first receiving opening of the first receiving chamber and covering a second receiving opening of the second receiving chamber;

wherein the first receiving chamber includes a heating element for heating a first consumable when accommodated in the first receiving chamber, and wherein the second cavity includes electrical contacts connectable to an external atomization element of a second consumable for atomization of the second consumable when accommodated in the second receiving chamber.

The device housing may include a third or further receiving chamber for receiving and accommodating a third or further consumables.

In an embodiment, the aerosol-generating device may allow the use of two or more different consumables, either individually or in combination. The device may provide a choice of which consumable to use. The device may also provide a choice of different combinations of consumables to use.

When used in combination, the two or more consumables may be used in parallel, or sequentially. In a parallel use, an airflow through the consumables may be formed through both consumables in parallel, and may be combined in a mouthpiece prior to exiting the device. In a sequential use, an airflow entering the device may pass through one consumable and subsequently through the second consumable, and possibly subsequently through a third or further consumable, prior to exiting the device.

Heating of a consumable may be performed resistively or inductively. Resistive heating may be provided in the device or in the consumable. With inductive heating, an inductor, for example an induction coil, may be provided in the device. A susceptor material heated by the inductor may be provided in the device or in the consumable.

In an embodiment, the device includes a heating element for heating a consumable. The heating element may be arranged in a receiving chamber wall, or may extend into the receiving chamber. For example, resistively heatable metal tracks may be arranged at a receiving chamber wall, or resistively heatable wires may be arranged in the receiving chamber wall. An inductor in the form of an induction coil may be arranged in the receiving chamber wall, and may surround a consumable accommodated in the respective receiving chamber.

A heating element in the device may extend into the first receiving chamber or into the second receiving chamber. For example, the heating element may be a resistively heated heater blade or an elongated susceptor.

In an embodiment, the device also includes electrical contacts for an external atomization element included in the consumable. In an embodiment, the atomization element is a heating element. However, the external atomization element may, for example, also be another vaporization element for atomizing for example a liquid, such as for example a vibrating element.

A third or further receiving chamber may include no heating element and no electrical contacts for an external atomization element. A third or further receiving chamber may include a heating element or electrical contacts connectable to an external atomization element, and a heating element may be included in the consumable.

In an embodiment, all receiving chambers are arranged side by side in a device housing.

A sequential use of two or more consumables may be provided by a mouthpiece defining an airflow into and out of the device. In an embodiment, depending on the position on the mouthpiece on the device housing, a sequence of the consumables that the airflow passes through may be selected.

In an embodiment, the mouthpiece may include an inlet opening and an outlet opening in direct fluid connection with each other. The inlet opening may be aligned with, for example, the first receiving chamber. The mouthpiece also includes an airflow inlet. The airflow inlet is aligned with the second receiving chamber. Thereby, an airflow passageway is formed from the airflow inlet in the mouthpiece through the second receiving chamber, then through the first receiving chamber into the mouthpiece to the outlet opening, prior to the airflow exiting the device. In a different position of the mouthpiece where the inlet opening is aligned with the second receiving chamber, a sequence of an airflow passing through the receiving chambers and consumables may be changed.

The device may generally include a selection member for selecting a consumable to be used, for example for a single use of one consumable, only. The selection member may be arrangeable in a first position and a second position. In the first position, the selection member leaves open an airflow passageway through the first receiving chamber and closes the airflow passageway through the second receiving chamber. In the second position, the selection member closes the airflow passageway through the first receiving chamber and leaves open the airflow passageway through the second receiving chamber.

The selection member may be arranged in the mouthpiece or in the device housing. As described above, a selection member integrated in the mouthpiece provides a simple means for selecting use of one single consumable as well as for use of a specific sequence of two or more consumables.

The selection member may, for example, be a switch or valve arranged to be movable into an airflow passageway in the device, and may be removable from the airflow passageway, thereby closing the airflow passageway through the first receiving chamber and leaving open the airflow passageway through the second receiving chamber, or leaving open the airflow passageway through the first receiving chamber and closing the airflow passageway through the second receiving chamber.

In an embodiment, the selection member is integrated into the mouthpiece. The mouthpiece may include an inlet opening, which is alignable with either one of the first receiving chamber or the second receiving chamber when the mouthpiece is mounted to the device housing. The mouthpiece may include a bottom wall closing either one of the first or second receiving chamber that is not aligned with the inlet opening.

These and further features of the device have been described relating to the aerosol-generating device, including a selection member for selecting between a first consumable and a second consumable.

For example, the receiving chamber walls may each include an aligning element for aligning a consumable in a respective receiving chamber. The consumables may each include an aligning member corresponding to the aligning elements of the receiving chambers. In an embodiment, an aligning element of the receiving chamber and an aligning member of the consumable may be joined via a form-fit.

In an embodiment, the device may include a controller for controlling an operation of the device. In particular, the controller is configured to operate all consumables in the device. In particular, the controller is configured to operate at least two, and optionally all, consumables in the device in combination. A controller may be configured to selectively vary a heating or another atomization process of two consumables. Thus, one consumable may be used more intensely than another consumable at one time, while using the one consumable less intensely than the other consumable at another time. The device may be provided with respective adjustment input capabilities.

Structural Embodiments

The aerosol-generating device illustrated in FIG. 1 includes a device housing 1 and a mouthpiece 2, depicted in a disassembled and an assembled state. The device housing 1 includes two shaped receiving chambers 10,11, that may be tubular in shape, for receiving two consumables 30,31. The consumables may be tubular shaped and may entirely be accommodated in the receiving chambers 10,11.

The consumables 30,31 each include a radially extending lug 300 at the circumference of the proximal end of the consumable. The receiving chamber walls of the receiving chambers 10,11 each include a longitudinally arranged slit 100. The lug 300 of the consumable 30,31 is arranged in the slit 100 when the consumable is accommodated in the receiving chamber 10,11. The lug 300 has a size such as to project from the housing device 1. The lug 300 is visible and may be felt when the consumable 30,31 is accommodated in the device also when the mouthpiece 2 and housing 1 are assembled. Removal of the consumables 30,31 may be supported by pushing the lug 300 out of the slit 100.

In an embodiment, the consumables 30,31 are aerosol-generating articles including an aerosol-forming substrate. In an embodiment, the consumables 30,31 are different types of consumables. A first consumable 30 may, for example, be a heatable aerosol-forming liquid (or, alternatively referred to as a "pre-vapor formulation") consumable that may contain a cartridge, where an atomization source is incorporated in the cartridge. The second consumable 31 may, for example, be a heatable or non-heatable tobacco material containing article.

The device housing 1 and mouthpiece 2 may have the form of flat cylinders. The mouthpiece 2 is additionally tapered versus the outlet 20. In an embodiment, the size of the housing 1 is selected in relation to the sizes of the two consumables 30,31, where the consumables 30,31 may be arranged side-by-side in the housing 1. The mouthpiece 2 covers both consumables 30,31, or both receiving chamber inlets, respectively.

Figure 2:
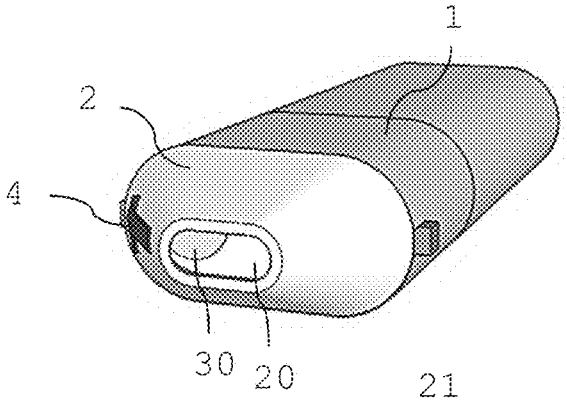
FIG. 2 illustrates an aerosol-generating device with a selection member position aligned with a first consumable, in accordance with an example embodiment.
Figure 3:
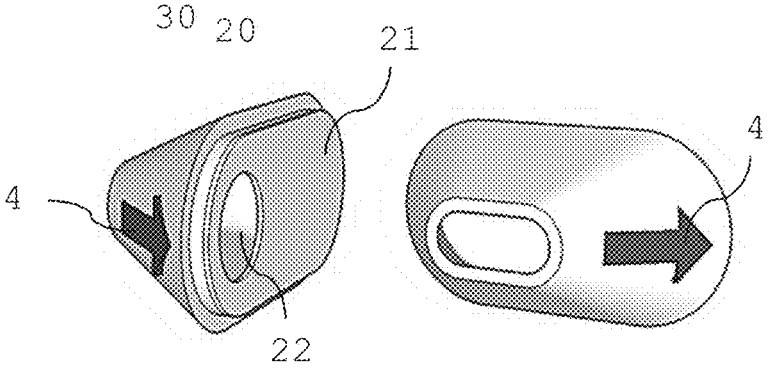
FIG. 3 illustrates a selection member in the form of an inlet opening in the mouthpiece, in accordance with an example embodiment.

FIG. 2 illustrates a device for two consumables 30,31 arranged side-by-side, wherein one consumable 30 may be seen through the outlet opening 20 of the mouthpiece 2. An indicator 4 in the form of an arrow indicates the consumable 30 that is selected to be used. Such a selection is made by positioning the mouthpiece 2 on the device housing 1. As may be seen in FIG. 3, a bottom wall 21 of the mouthpiece 2 includes an inlet opening 22. The inlet opening 22 is arranged eccentrically on one side of the bottom wall 21 of the mouthpiece 2. The indicator 4 is arranged on that side of the mouthpiece 2 with the inlet opening 22.

By assembling the mouthpiece 2 and the device housing 1, the inlet opening 22 is aligned with one of the two receiving chambers 10,11 or with one of the two consumables 30,31 accommodated in the receiving chambers 10,11. The remaining bottom wall 21 is aligned with the other receiving chamber and closes a receiving opening of that receiving chamber to close an airflow passageway between that receiving chamber and the mouthpiece 2.

Figure 4:
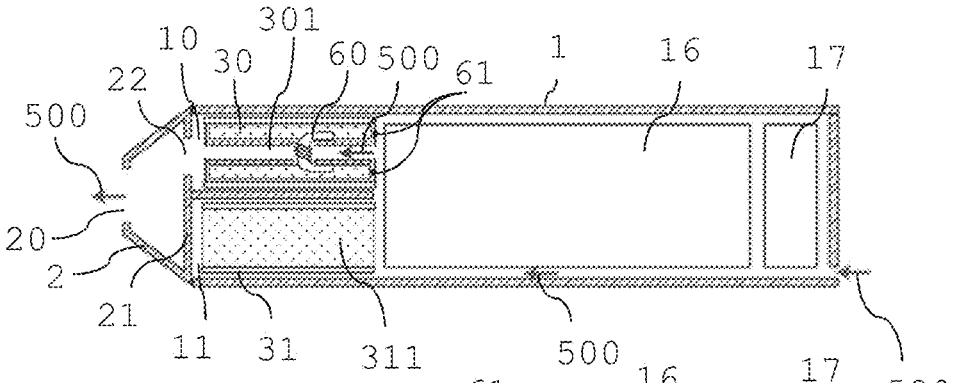
FIG. 4 illustrates a cross-sectional view of a device including a heatable and a non-heated consumable, in accordance with an example embodiment.
Figure 5:
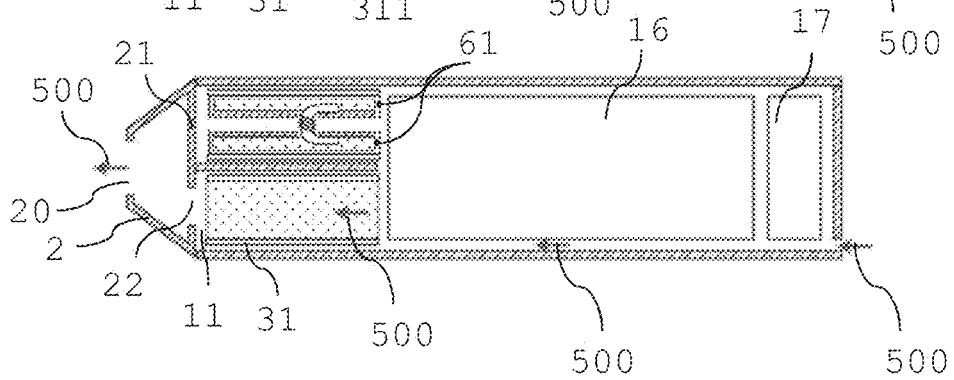
FIG. 5 illustrates a cross-sectional view of a device including a heatable and a non-heated consumable, in accordance with an example embodiment.

FIG. 4 and FIG. 5 illustrate cross-sectional views of an aerosol-generating device, with an airflow 500 passing through a first consumable 30 (FIG. 4), and an airflow 500 passing through a second consumable 31 (FIG. 5).

The device housing 1 includes two side-by-side arranged receiving chambers two consumables 30,31 accommodated in the receiving chambers 10,11, a power source 16 and a controller 17 for controlling the power source 16 and the device.

The mouthpiece 2 includes a bottom wall 21 including an inlet opening 22. In FIG. 4, the inlet opening 22 is aligned with the first receiving chamber 10 and the first consumable 30. The bottom wall 21 of the mouthpiece 2 closes the proximal end of the second receiving chamber 11.

In FIG. 5, the inlet opening 22 is aligned with the second receiving chamber 11 and the second consumable 31. The bottom wall 21 of the mouthpiece 2 closes the proximal end of the first receiving chamber 10.

The first consumable 30 is a heated liquid containing cartridge. An aerosol-forming liquid is contained in a hollow tubular shaped reservoir. The reservoir may, for example, be filled with a high retention material. The liquid is supplied by a wick material to a coil heater 60, where the liquid is heated and evaporated. In a central conduit 301 of the first consumable 30, the evaporated liquid may be led out of the consumable 30. The first receiving chamber 10 includes electrical contacts 61 for an electrical current from the power source 16 to the coil heater 60 of the first consumable 30.

The second consumable 31 is a tubular shaped shell filled with a solid tobacco material 311, for example shredded tobacco or homogenized tobacco material. In the embodiments of FIGS. 4 and 5, the second consumable 31 is not heated and an airflow passing through the tobacco material 311 picks up tobacco flavor.

In FIG. 4, the device is in a state for using the first consumable 30. In FIG. 4, an airflow 500 enters the device at a distal end of the device, passes through the device housing 1 and enters the distal end of the first receiving chamber 10. The airflow 500 passes the receiving chamber 10 and passes through the central conduit 301 of the first consumable 30. Thereby, the airflow 500 picks up evaporated substances, for example flavors or nicotine. The airflow 500 passes through the inlet opening 22 of the mouthpiece 2, which is aligned with the first consumable 30, and the airflow 500 exits the device through the outlet opening 20 of the mouthpiece 2. No substances of the second consumable 31 are included in the airflow 500.

In FIG. 5, the device is in a state for using the second consumable 31. In FIG. 5, an airflow 500 enters the device at the distal end of the device and passes through the device housing 1, where it enters the distal end of the second receiving chamber 11. The airflow 500 passes the tobacco material 311 of the second consumable 31 in the second receiving chamber 11. Thereby, the airflow 500 picks up tobacco flavor. The airflow 500 passes through the inlet opening 22 of the mouthpiece 2, which is aligned with the second consumable 31, and the airflow 500 exits the device through the outlet opening 20 of the mouthpiece 2. No substances of the first consumable 30 are included in the airflow 500. In an embodiment, while the second consumable 31 is selected, the first consumable 30 is not heated.

Figure 6:
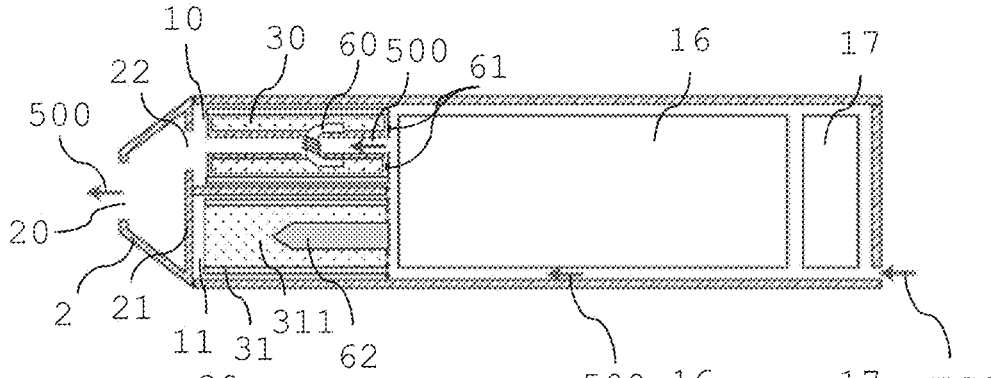
FIG. 6 illustrates a cross-sectional view of a device including two different heatable consumables, in accordance with an example embodiment.
Figure 7:
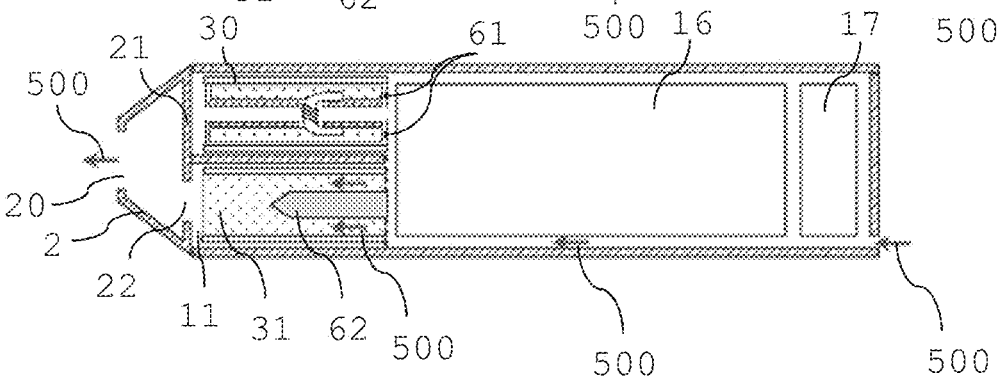
FIG. 7 illustrates a cross-sectional view of a device including two different heatable consumables, in accordance with an example embodiment.

FIG. 6 and FIG. 7 illustrate cross-sectional views of an aerosol-generating device, with an airflow 500 passing through a first consumable 30 (FIG. 6), and an airflow 500 passing through a second consumable 31 (FIG. 7). The same reference numbers are used, as compared to the embodiments described above.

The state and operation of the device shown in FIG. 6 is the same as the operation of the device of FIG. 4, and therefore the second consumable 31 is not active and not in use.

In the embodiment of FIG. 7, the second consumable 31, which may be a tobacco containing substrate 311, is heated by a heater blade 62. In an embodiment, the heater blade 62 is a resistively heated blade that extends into the second receiving chamber 11. The second consumable 31 is pushed over the blade 62 when being accommodated in the receiving chamber 11.

In an embodiment, the consumable that is not in use is not heated. The controller 17 of the device may be configured accordingly, such that an electrical current is provided either to the selected heater blade 62 or to the selected coil heater 60, though no electrical current is sent to the non-selected consumable.

The position of the mouthpiece 2, which may be used to select one of the consumables, may be connected to the controller 17, thereby giving information to the controller 17 identifying the consumable that is in use.

Figure 8:
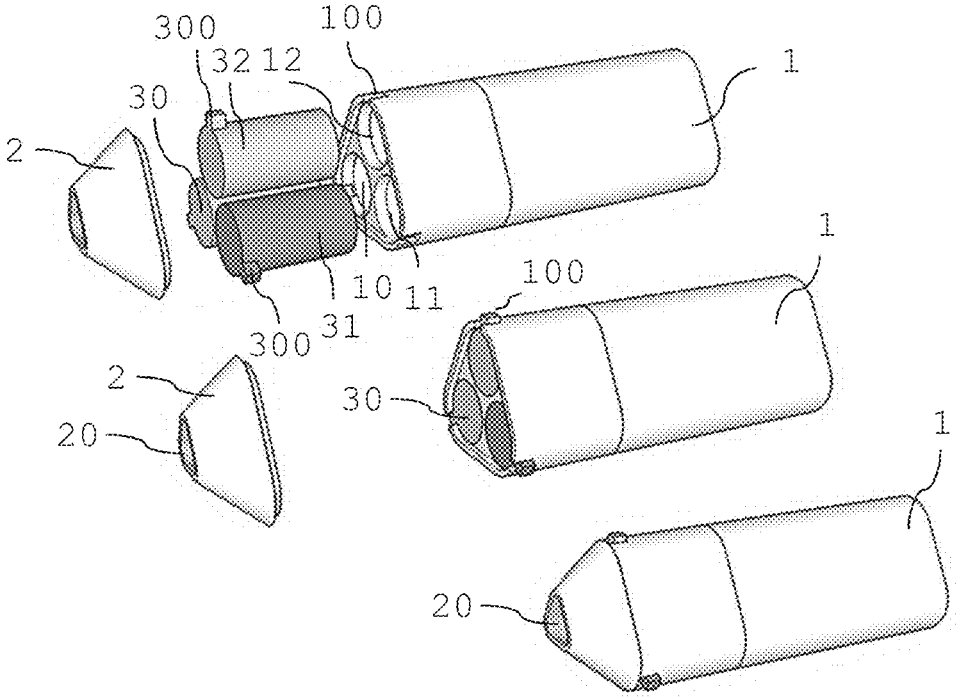
FIG. 8 illustrates assembled and disassembled views of an aerosol-generating device including three consumables, in accordance with an example embodiment.

FIG. 8 illustrates an aerosol-generating device for three side-by-side consumables 30,31,32. Identical elements of the device are provided with the same reference numbers, as compared to the embodiments described above.

The device includes a triangular shaped device housing 1 and a mouthpiece 2 in disassembled and assembled state. The device housing 1 includes three tubular shaped receiving chambers 10,11,12 for receiving three consumables 30,31,32. The consumables are tubular shaped and may entirely be accommodated in the receiving chambers 10,11, 12.

The mouthpiece 2 covers all three consumables 30,31,32 and includes one outlet opening 20.

The consumables 30, 31, 32 each include a radially extending lug 300 at the circumference of each proximal end of the consumables 30, 31, 32. The receiving chamber walls of the receiving chambers 10,11,12 each include a longitudinally arranged slit 100. The slits 100 are arranged each at a corner of the triangular-shaped device housing 1. The lugs 300 of the consumables 30,31,32 are each arranged in the respective slits 100 when the consumables 30, 31,32 are accommodated in the respective receiving chambers 10,11, 12. The lugs 300 project from the device housing 1 and are visible when the mouthpiece 2 and the housing 1 are assembled. Removal of the consumables 30,31,32 is supported by pushing the lugs 300 out of the slits 100.

The three consumables 10,11,12 may be identical aerosol-generating articles including an aerosol-forming substrate. In an embodiment, the three consumables 30,31,32 are different kinds of consumables. While a first consumable 30 may, for example, be a heatable aerosol-forming liquid containing cartridge, the second consumable 31 may, for example, be a heatable or non-heatable tobacco material containing article. A third consumable 32 may, for example, include a different aerosol-forming substrate, for example a liquid or a solid, may include a substrate in different form (bulk, powder), may contain different substances (such as flavors, stimulating substances, etc.), or may use different heating methods as compared to the first and the second consumables 30,31.

Figure 9:
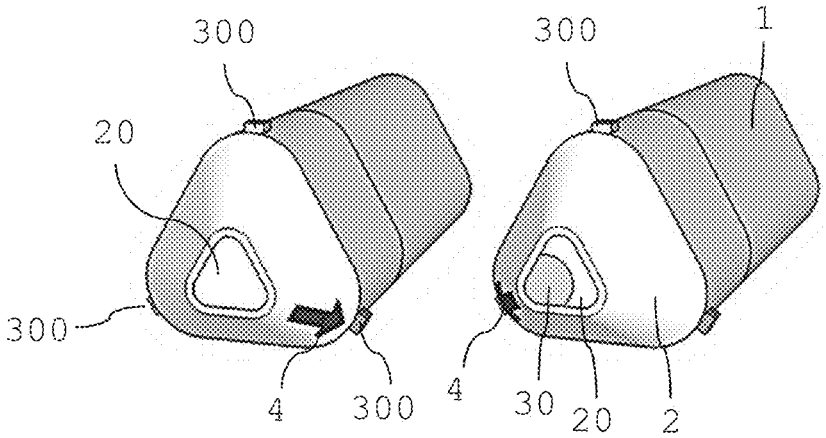
FIG. 9 illustrates a device with three consumables in two different mouthpiece positions, in accordance with an example embodiment.

FIG. 9 illustrates a device with three consumables 30,31, 32, where the device allows for the selection of two different consumables 30,31. In particular, the second consumable 31 may be selected, or the first consumable 30 may be selected, as shown in FIG. 9. The section is indicated by indicator 4, which may be in the form of an arrow on the mouthpiece 2.

The selection of a consumable is made by positioning the mouthpiece 2 on the device housing 1 so that the arrow 4 is aligned with the respective corner of the device housing 1.

Figure 10:
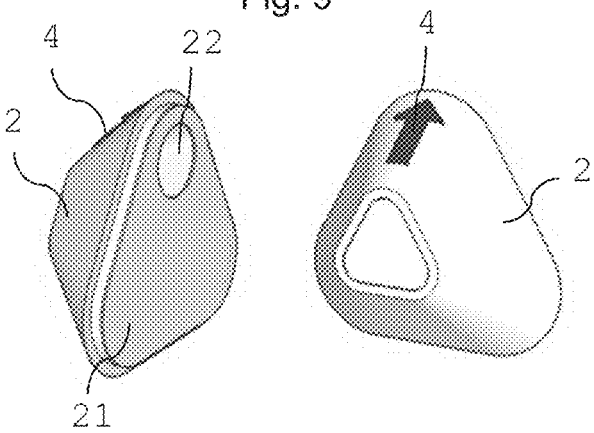
FIG. 10 illustrates a selection member in the form of an inlet opening in another embodiment of a mouthpiece, in accordance with an example embodiment.

As shown in FIG. 10, a bottom wall 21 of the mouthpiece 2 includes an inlet opening 22. The indicator 4 is arranged on that side of the mouthpiece 2 including the inlet opening 22. The inlet opening 22 is arranged in one corner of the triangular bottom wall 21 of the mouthpiece 2. By assembling the mouthpiece 2 and the device housing 1, the inlet opening 22 is aligned with one of the three receiving chambers 10,11,12, which causes the opening 22 to also be aligned with one of the three consumables 30,31,32. The remaining bottom wall 21 is aligned with the other two non-selected receiving chambers, to close the respective receiving openings for the non-selected receiving chambers.

Figure 11:
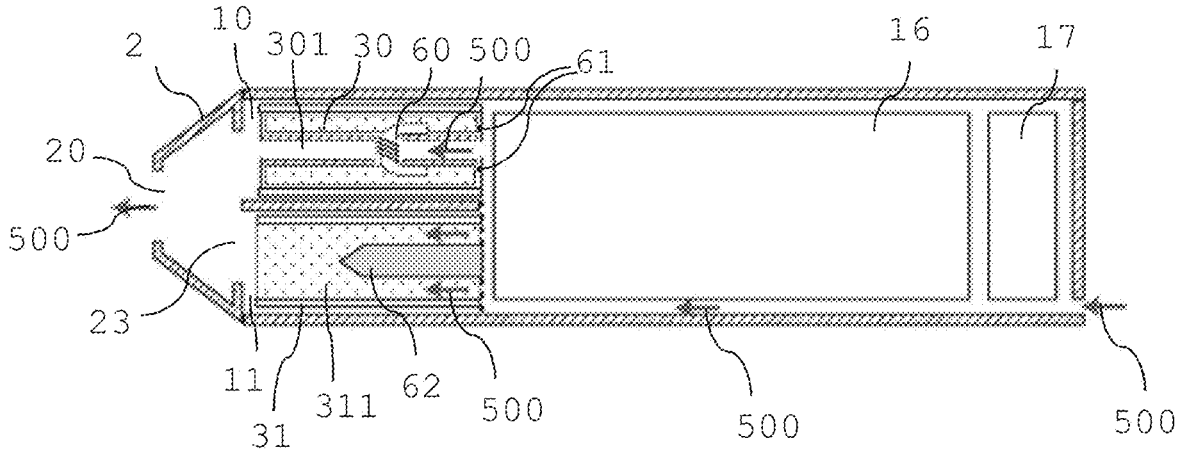
FIG. 11 illustrates a cross-sectional view of a device providing parallel airflow through two heated consumables, in accordance with an example embodiment.

FIG. 11 illustrates a cross-sectional view of an aerosol-generating device, and an airflow 500 passing in parallel through both a first consumable 30 and through a second consumable 31. The same reference numbers are used for the same elements of the device, as compared to the previously described embodiments.

The mouthpiece 2 covers both receiving chambers 10,11 and include an open bottom 23.

The first consumable 30 is a heated liquid containing cartridge. An aerosol-forming liquid is contained in a hollow tubular shaped reservoir. The liquid is supplied by a wick material to a coil heater 60, where the liquid is heated and evaporated. In a central conduit 301 of the first consumable 30, the evaporated liquid is discharged from the first receiving chamber 10. The first receiving chamber 10 includes electrical contacts 61 for providing an electrical current from the power source 16 to the coil heater 60 of the first consumable 30.

The second consumable 31 is a tubular shaped shell filled with a solid tobacco material 311, which may for example be a shredded tobacco or an homogenized tobacco material. The tobacco substrate 311 of the second consumable 31 is heated by a heater blade 62. In an embodiment, the heater blade 62 is a resistively heated blade extending into the second receiving chamber 11. The second consumable 31 is pushed over the blade when fitted into the receiving chamber 11.

In an embodiment, both consumables 30,31 are heated in parallel and provide substances to the airflow 500.

The airflow 500 entering the distal end of the device passes through the device housing 1 and enters the distal ends of the first and second receiving chambers 10,11. The airflow 500 passes though the receiving chambers 10,11 and through the first and second consumables 30,31. The airflow 500 therefore picks up evaporated substances from both consumables 30,31. The airflow 500 passes through the open bottom 23 of the mouthpiece 2, which is aligned with the first and second consumable 30,31. In the mouthpiece 2, the airflow 500 passing through the two consumables 30,31 is mixed, and the airflow 500 is discharged through the outlet opening 20 of the mouthpiece 2.

In an embodiment, the controller 17 of the device is configured to provide a required electrical current to the heater blade 62 and the coil heater 60.

Figure 12:
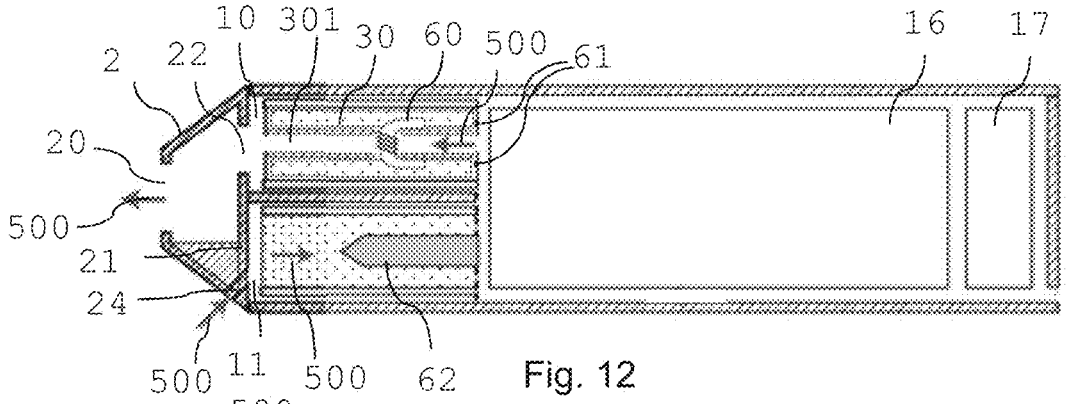
FIG. 12 illustrates a cross-sectional view of a device providing sequential airflow through two heated consumables, in accordance with an example embodiment.
Figure 13:
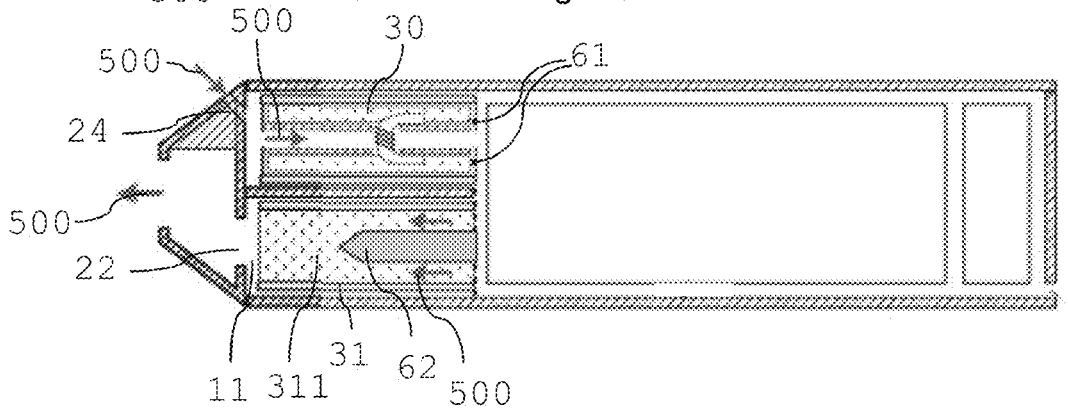
FIG. 13 illustrates the device of FIG. 12 with another mouthpiece position, in accordance with an example embodiment.

FIG. 12 and FIG. 13 illustrate cross-sectional views of an aerosol-generating device, and an airflow 500 passing subsequently through a first consumable 30 and a second consumable 31, or vice versa. The same reference numbers are used for the same elements, as compared to the embodiments described above.

In the embodiments of FIGS. 12 and 13, the mouthpiece 2 includes a bottom wall 21 including an inlet opening 22. In FIG. 12, the inlet opening 22 is aligned with the first receiving chamber 10 and the first consumable 30.

In FIG. 13, the inlet opening 22 is aligned with the second receiving chamber 11 and the second consumable 31.

The mouthpiece 2 further includes an airflow inlet 24. The airflow inlet 24 is arranged in a separate portion of the mouthpiece 2, and is separated from the inlet and outlet openings 22,20 of the mouthpiece 2. The airflow inlet 24 provides a fluid connection between the environment and the non-selected consumable that is not aligned with the inlet opening 22 of the mouthpiece 2.

In FIG. 12, where the inlet opening 22 is aligned with the first consumable 30, an airflow 500 enters the device through the airflow inlet 24 of the mouthpiece 2. The airflow 500 passes through the second consumable 30 in the second receiving chamber 11. The airflow 500 therefore picks up substances evaporated from the heated tobacco substrate. The airflow 500 exits the second consumable 31 at the distal end of the second receiving chamber 11. The airflow 500 then enters the distal end of the first receiving chamber 10 and passes through the central conduit 301 of the first consumable 30. The airflow 500 therefore picks up the evaporated liquid from the first consumable 30. The mixed airflow 500 then leaves the first receiving chamber 10 through the inlet opening 22 of the mouthpiece 2 that is aligned with the first receiving chamber 10. The airflow 500 containing the aerosolized substrates from the first and second consumables 30,31 exits the device via the outlet opening 20 of the mouthpiece 2.

In FIG. 13, the mouthpiece 2 is positioned in a second position such that the inlet opening 22 is aligned with the second consumable 31, and the airflow inlet 24 is aligned with the first consumable 30. Accordingly, an airflow 500 passes first through the first consumable 30 and subsequently through the second consumable 31. The airflow 500 containing the aerosolized substrates of the first and second consumables 30,31 exits the device via the outlet opening 20 of the mouthpiece 2. This embodiment therefore allows for a selection in the sequence by which the airflow 500 flows through the consumables 30,31.

The specific embodiments and examples described above illustrate but do not limit the example embodiments. It is to be understood that other embodiments may be made, and the specific embodiments and examples described herein are not exhaustive.

What is claimed is:

1. A method of making a device, comprising:

forming a housing that defines chambers, the chambers including a first chamber and a second chamber, each of the chambers being configured to accept a consumable; and arranging a mouthpiece to be selectively connected to the housing on an end of the chambers and moveable between a first position and a second position, the first position aligning an inlet opening of the mouthpiece to direct at least one first airflow in a first direction through the first chamber and in a second direction through the second chamber, the second position aligning the inlet opening of the mouthpiece to direct the at least one first airflow in the first direction through the second chamber and in the second direction through the first chamber, the first direction and the second direction being substantially opposite directions.

2. The method of claim 1, wherein the forming forms such that the first chamber and the second chamber are divided by a chamber wall that is in a fixed location relative to the housing.

3. The method of claim 1, wherein the arranging arranges a wall of the mouthpiece to define the inlet opening, the wall facing the chambers when the mouthpiece is selectively connected to the housing.

4. The method of claim 3, wherein the arranging arranges an end of the mouthpiece to define an outlet opening, the inlet opening and the outlet opening being in communication with each other.

5. The method of claim 1, wherein the arranging arranges the mouthpiece to substantially cover a first chamber opening of the first chamber when the mouthpiece is in the second position and substantially cover a second chamber opening of the second chamber when the mouthpiece is in the first position.

6. The method of claim 1, further comprising:

first defining a first airflow inlet, the first airflow inlet being configured to allow the at least one first airflow to enter at least one of the chambers.

7. The method of claim 6, wherein the first defining defines the first airflow inlet to be within the mouthpiece.

8. The method of claim 7, further comprising:

second defining the inlet opening within the mouthpiece, the inlet opening and the first airflow inlet being on opposite sides of the mouthpiece.

9. The method of claim 8, further comprising:

third defining a second airflow inlet, the second airflow inlet being configured to allow at least one second airflow to enter at least one of the chambers, the mouthpiece and the first airflow inlet being on a first side of the chambers and the second airflow inlet being on a second side of the chambers, the first side and the second side being on opposing sides of the chambers, the first airflow inlet and the second airflow inlet being in fluid communication with each other.

10. The method of claim 9, wherein the arranging arranges the mouthpiece such that the first position directs the at least one first airflow from the first airflow inlet to travel through the first chamber before being redirected and combined with the at least one second airflow prior to traveling through the second chamber, and the second position directs the at least one first airflow from the first airflow inlet to travel through the second chamber before being redirected and combined with the least one second airflow prior to traveling through the second chamber.

11. The method of claim 6, wherein the arranging arranges the mouthpiece such that the first position directs the at least one first airflow from the first airflow inlet into the first chamber before being redirected through the second chamber, and the second position directs the at least one first airflow from the first airflow inlet into the second chamber before being redirected through the first chamber.

12. The method of claim 1, further comprising:

providing at least one aligning element within the housing, the at least one aligning element being configured to align a first consumable and a second consumable in a fixed orientation within the first chamber and the second chamber, respectively.

13. The method of claim 12, wherein the providing provides the at least one aligning element in a chamber wall of the first chamber, the second chamber, or both the first chamber and the second chamber.

14. The method of claim 1, further comprising:

operatively arranging at least one heating element within the housing, the at least one heating element being configured to heat a first consumable and a second consumable within the first chamber and the second chamber, respectively, the at least one heating element being one of an internal heating element or an external heating element.

15. The method of claim 14, wherein the operatively arranging arranges the at least one heating element in or along a chamber wall of the first chamber, the second chamber or both the first chamber and the second chamber.

16. The method of claim 14, wherein the operatively arranging arranges the at least one heating element to extend into the first chamber, the second chamber or both the first chamber and the second chamber.

17. The method of claim 1, wherein the forming forms such that the chambers are arranged in a side-by-side orientation within the housing.

18. The method of claim 1, wherein the forming forms a third chamber within the housing.

19. The method of claim 18, wherein the arranging arranges the mouthpiece to be selectively connected to the housing in at least a third position.

20. The method of claim 1, further comprising:

inserting a first consumable and a second consumable into the first chamber and the second chamber, respectively.

* * * * *